US011220906B2

(12) United States Patent
Catoi

(10) Patent No.: US 11,220,906 B2
(45) Date of Patent: Jan. 11, 2022

(54) ROCK BOLT

(71) Applicant: Peter Bryce Catoi, Attadale (AU)

(72) Inventor: Peter Bryce Catoi, Attadale (AU)

( * ) Notice: Subject to any disclaimer, the term of this patent is extended or adjusted under 35 U.S.C. 154(b) by 0 days.

(21) Appl. No.: 16/765,471

(22) PCT Filed: Nov. 13, 2018

(86) PCT No.: PCT/AU2018/051215

§ 371 (c)(1),
(2) Date: May 19, 2020

(87) PCT Pub. No.: WO2019/095006

PCT Pub. Date: May 23, 2019

(65) Prior Publication Data

US 2020/0277857 A1 Sep. 3, 2020

(30) Foreign Application Priority Data

Nov. 20, 2017 (AU) ..... 2017904679

(51) Int. Cl.
*E21D 21/00* (2006.01)

(52) U.S. Cl.
CPC ..... *E21D 21/008* (2013.01); *E21D 21/0033* (2013.01)

(58) Field of Classification Search
CPC ..... E21D 21/008; E21D 21/0033; E21D 21/0046; E21D 21/00
See application file for complete search history.

(56) References Cited

U.S. PATENT DOCUMENTS 4,453,845 A * 6/1984 Donan, Jr. ..... E21D 21/008 405/259.3
2016/0215805 A1* 7/2016 Andou ..... F16B 13/065

FOREIGN PATENT DOCUMENTS

GB 805797 * 12/1958

* cited by examiner

*Primary Examiner* — Sean D Andrish
(74) *Attorney, Agent, or Firm* — Tope-McKay & Associates

(57) ABSTRACT

A rock bolt (10) to be received in a drilled hole comprising a threaded shaft (12) and a sleeve (14) into which the shaft (12) is received. A plurality of openings (38) are provided along the length of the sleeve (14) and clamping assemblies (16) each having clamp members (36) are provided adjacent each opening (38). Wedge members (26) are located adjacent each of the clamp members (36) and the wedge members (26) each include a threaded bore for receiving the shaft (12) such that rotation of the shaft (12) moves the wedge members (26) into engagement with the clamp members (36) to move the clamp members (36) outwardly through the openings (38) to engage with an inner surface of the hole.

15 Claims, 9 Drawing Sheets

ROCK BOLT

FIELD OF THE INVENTION

The present invention relates to a rock bolt.

BACKGROUND TO THE INVENTION

Rock bolts are used for stabilising the surface of an excavated area. Such rock bolts are inserted into a drilled hole in the rock face and secured in place by mechanical or adhesive means to an inner end of the hole. An outer end of the rock bolt is secured adjacent the rock face and the rock bolt thereby transfers force from around the surface of the excavated surface to the more stable rock near the inner end of the drilled hole.

Mechanical rock bolts generally utilise an expanding component located adjacent an inner end of the hole. The outer end of the rock bolt is then clamped to the surface of the rock face and tensioned. Adhesive fixing of rock bolts comprises inserting an epoxy into the hole which then sets, providing bonding between the rock bolt and the rock along the length of the drilled hole. This provides an advantage by spreading the load over a greater length. However, the process of filling the hole with epoxy and then inserting and fixing the rock bolt can be time consuming.

The present invention relates to a rock bolt aimed at providing a mechanical connection to the rock in multiple locations within the drilled hole, in a manner which is simple and efficient to install.

SUMMARY OF THE INVENTION

According to one aspect of the present invention there is provided a rock bolt to be received in a drilled hole, the rock bolt comprising:

a threaded shaft;

a sleeve into which the shaft is received;

a plurality of openings along the length of the sleeve;

clamping assemblies having clamp members provided adjacent each opening; and wedge members located adjacent each of the clamp members;

wherein the wedge members include a threaded bore for receiving the shaft such that rotation of the shaft moves the wedge members into engagement with the clamp members to move the clamp members outwardly through the openings to engage with an inner surface of the hole.

Preferably the sleeve comprises a tubular member defining an annular space between the sleeve and the shaft such that the clamping assemblies are received within the annular space.

In a preferred embodiment, each of the clamping assemblies includes a pair of clamp members located on opposed sides of the shaft and a pair of opposed openings are provided for each clamping assembly.

Preferably each clamping assembly comprises a ring having an aperture for receiving the shaft and a pair of arms having first ends secured to the ring and second ends secured to the clamp members such that the wedge members are received on the shaft between the ring and the clamp members.

Preferably each of the openings includes a relatively wide first end portion through which one of the clamp members may extend and a relatively narrow second end portion through which a portion of one of the arms may extend.

Preferably first end portion of the opening is located on a side adjacent the inner end of the rock bolt.

Preferably the first end portion has a shape corresponding to the shape of the clamp member such that the clamp member and the second end portion of the opening has a shape corresponding to the shape of the arm.

In a preferred embodiment, the first end portion of the opening is rectangular and the second end portion of the opening comprises an elongate channel portion.

Preferably the arms of the clamping assemblies are angled outwardly such that the second ends of the arms are located further from the shaft than the first ends thereof and wherein the arms are flexible and resilient.

Preferably each of the wedge members comprises a tapered tubular member being circular in transverse cross section and tapering inwardly from a first end to a second end.

Preferably n each of the wedge members includes a pair of longitudinal grooves on opposed sides thereof for receiving the arms.

In a preferred embodiment, each of the clamp members comprises a part cylindrical member such that the clamp members extend around a portion of the outer surface of the shaft.

Preferably an outer surface of each of the part cylindrical members includes a plurality of circumferential ribs.

In a preferred embodiment, the ribs are triangular in shape such that when the ribs engage with an inner surface of the drilled hole, the ribs provide a greater resistance to sliding movement along the inner surface in a direction outwardly relative to the hole.

Preferably each of the clamp members includes longitudinal grooves extending centrally from the first ends to second ends thereof to receive the arms.

Preferably the sleeve is provided with a longitudinal slot extending along the length thereof to allow for some compression of the sleeve when inserted into the drilled hole.

Preferably the second end portions of the openings on one side of the sleeve are aligned with the slot such that the second end portions of the openings on said one side of the sleeve are formed by portions of the slot.

BRIEF DESCRIPTION OF THE DRAWINGS

The invention will now be described, by way of example, with reference to the following drawings, in which.

DETAILED DESCRIPTION OF PREFERRED EMBODIMENTS

Figure 1:
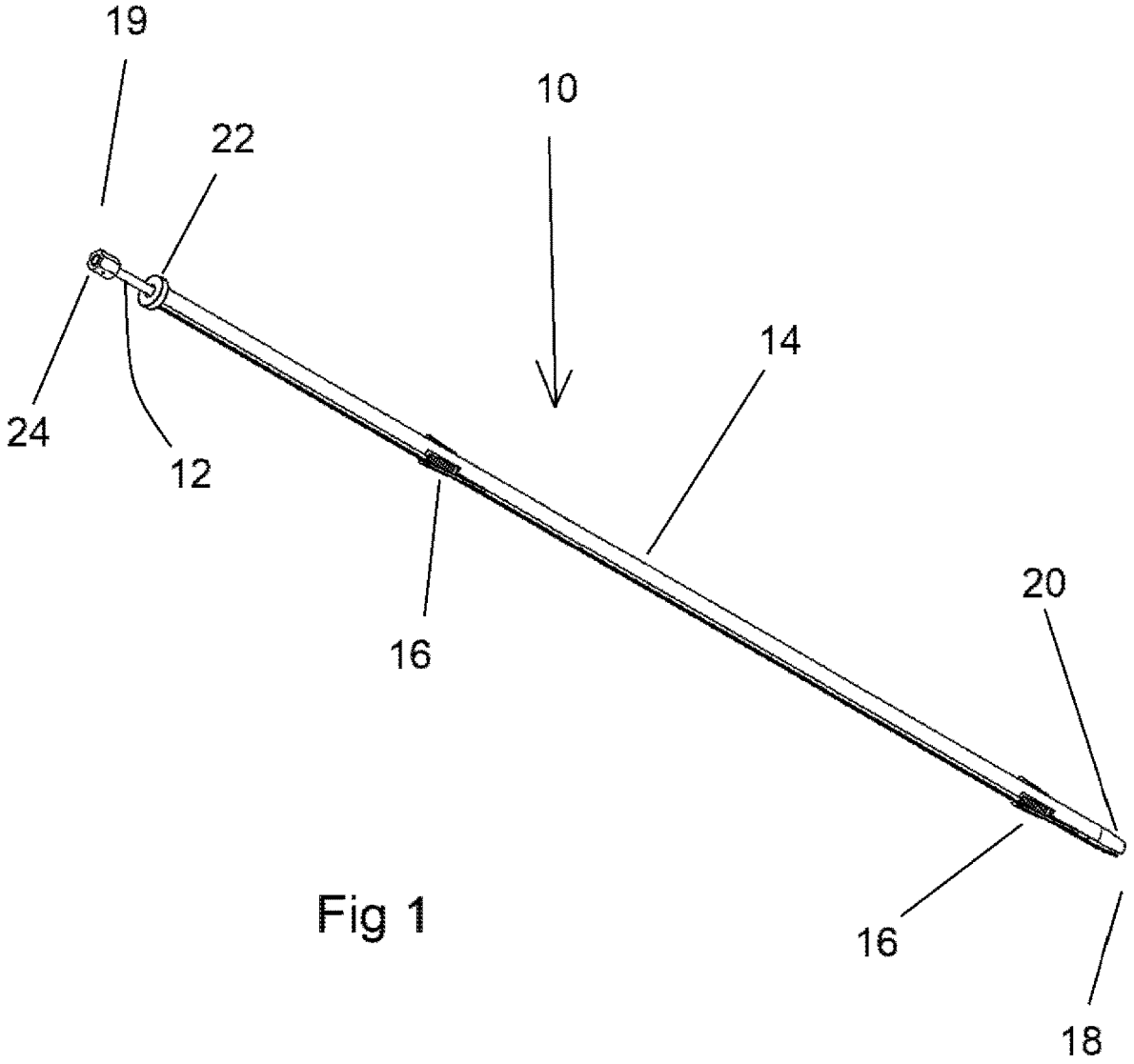
FIG. 1 is an upper perspective view of a rock bolt in accordance with the present invention.
Figure 2:
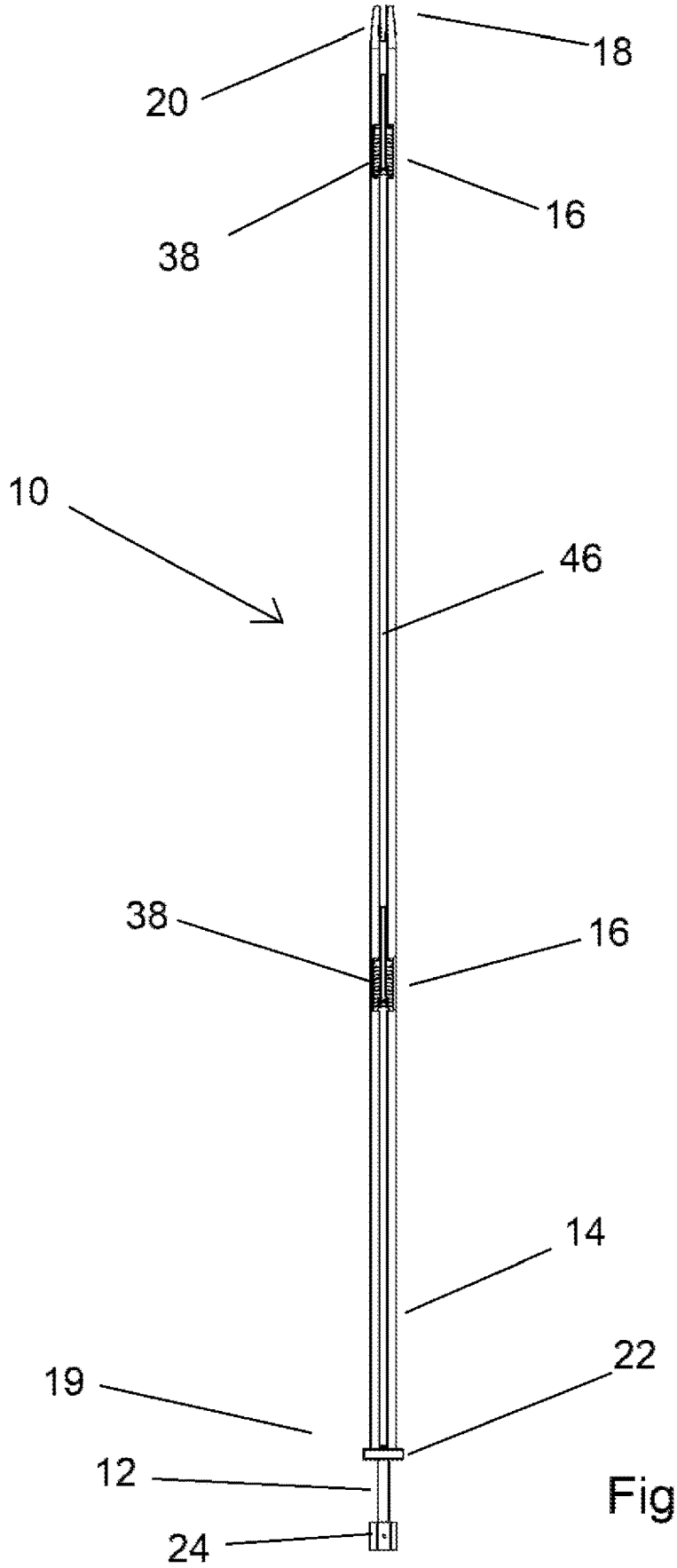
FIG. 2 is a side view of the rock bolt of FIG. 1.
Figure 3:
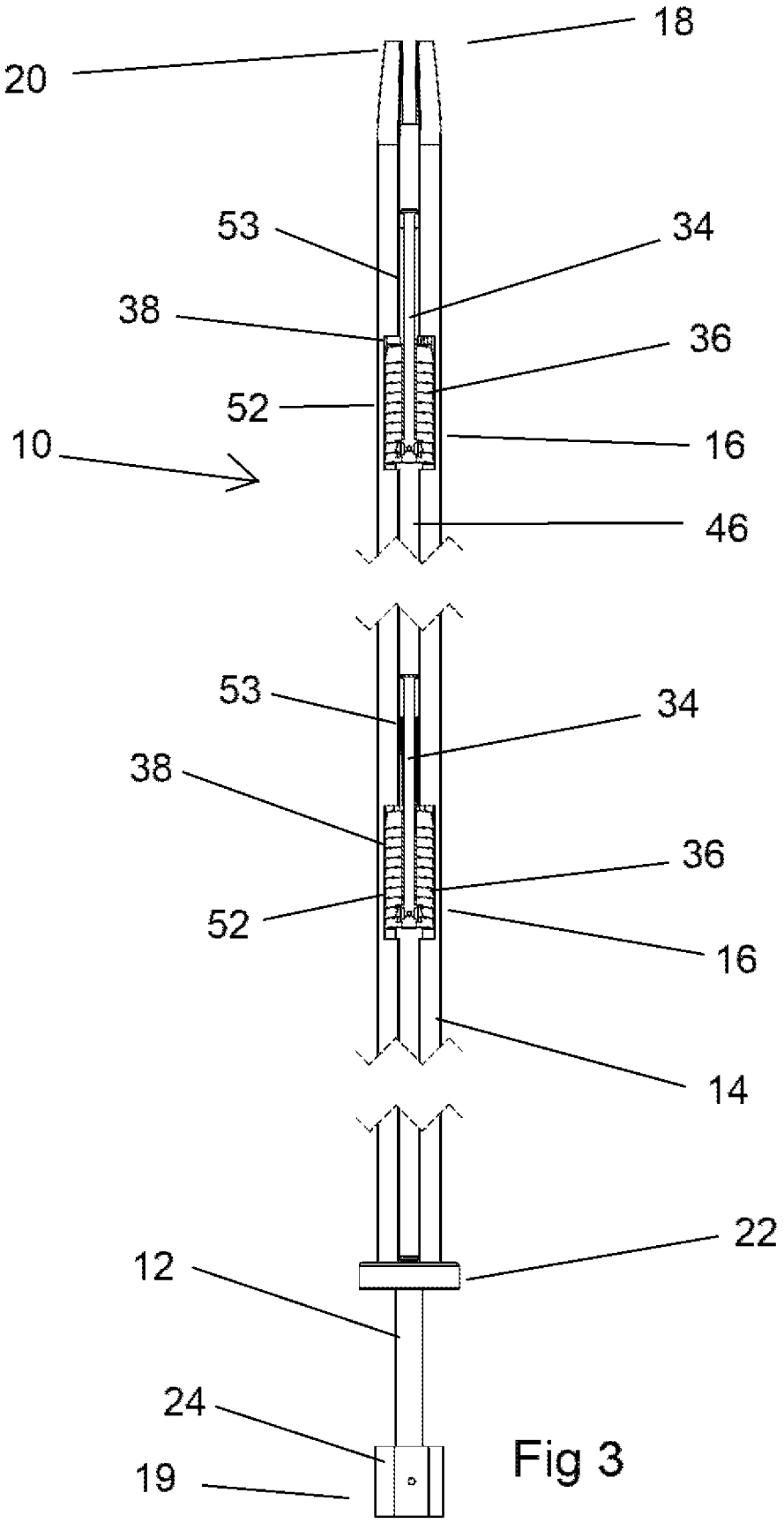
FIG. 3 is a side view showing a close-up view of sections of the rock bolt including clamping assemblies.
Figure 4:
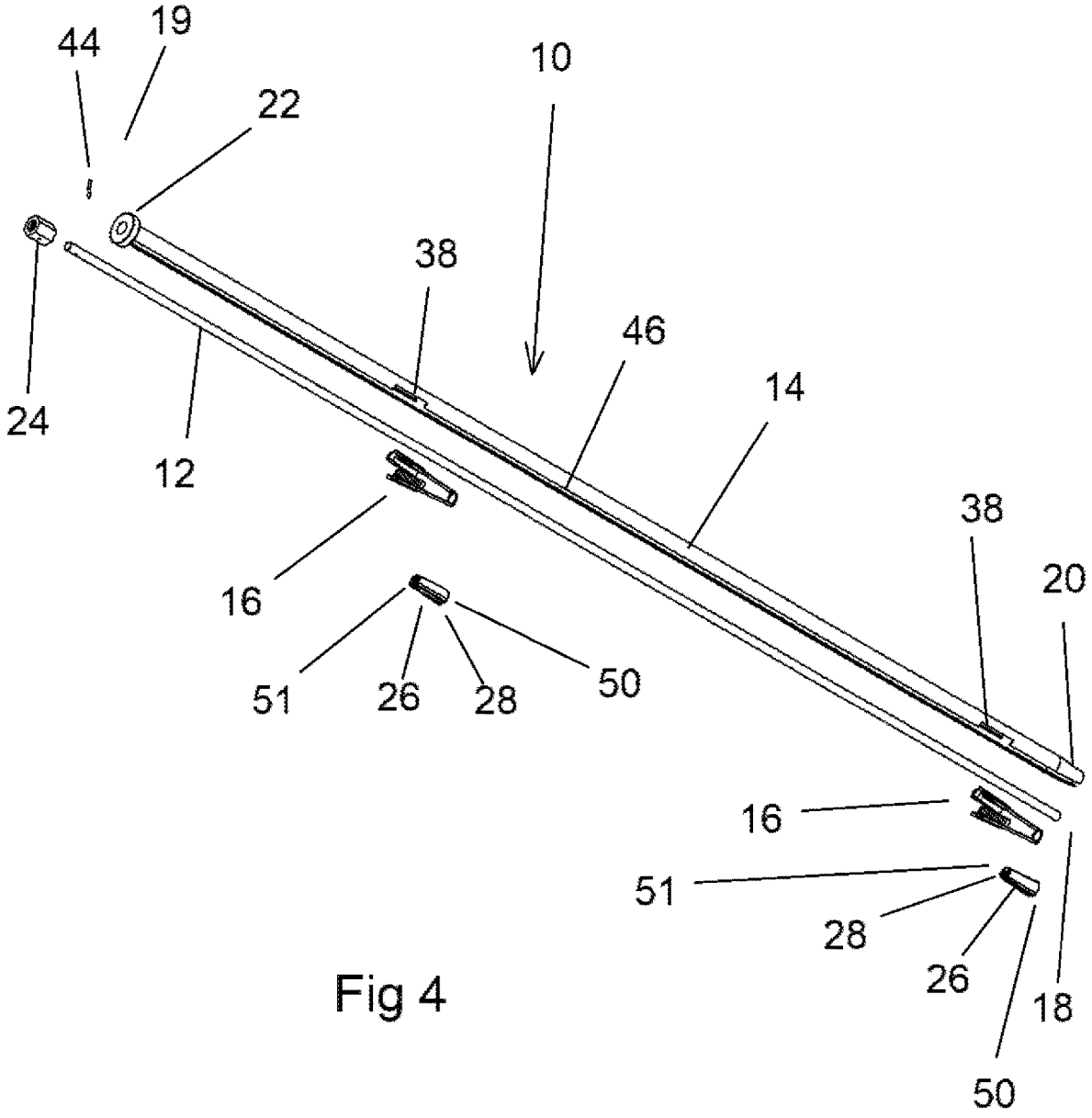
FIG. 4 is an exploded view of the rock bolt of FIG. 1.
Figure 5:
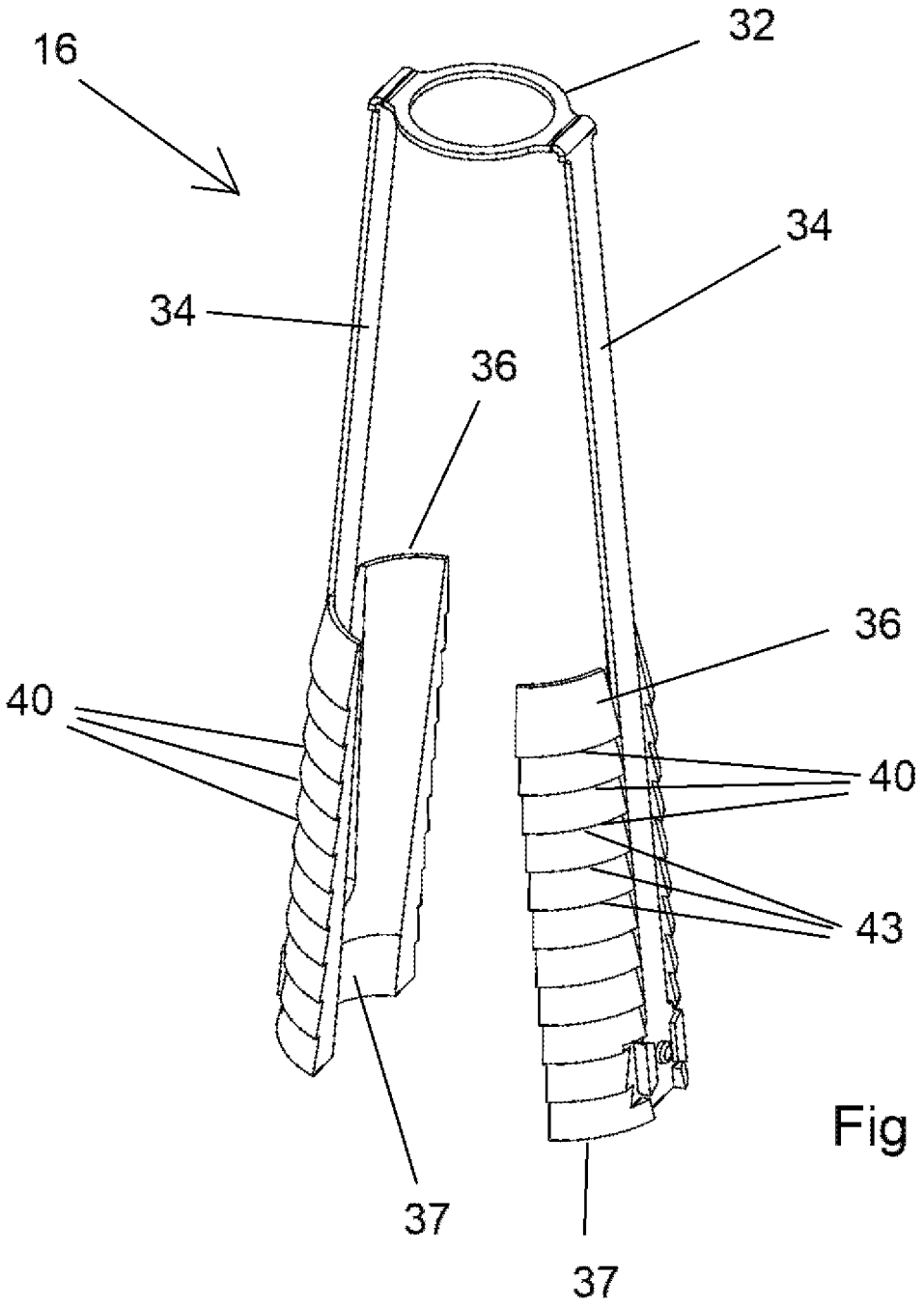
FIG. 5 is a perspective view of a clamping assembly of the rock bolt of FIG. 1.

Referring to the Figures, there is shown a rock bolt 10 comprising generally a shaft 12, a sleeve 14 and a plurality of clamping assemblies 16. The shaft 12 comprises an elongate member having a thread on an outer surface thereof. The shaft 12 is of a length to be received within a hole drilled into a rock face to be stabilised by the rock bolt 10. The shaft 12 is inserted into the drilled hole such that an inner end 18 of the rock bolt 10 is located adjacent the inner end of the hole and an outer end 19 of the rock bolt 10 protrudes outwardly from the hole.

The sleeve 14 comprises an elongate tubular member having a generally circular transverse cross section. The shaft 12 is receivable into the sleeve 14 such that an annular space is defined between an inner surface of the sleeve 14 and an outer surface of the shaft 12. The sleeve 14 is provided with a longitudinal slot 46 extending along the length thereof to allow for some compression of the sleeve when inserted into the drilled hole.

The shaft 12 is contained within the sleeve 14 adjacent the inner end 18 of the rock bolt 10 and extends outwardly from the sleeve 14 adjacent the outer end 19 of the rock bolt 10. The inner end 18 of the sleeve 14 includes a tapered end portion 20 to aid in inserting the rock bolt 10 into the drilled hole. The outer end 19 of the sleeve 14 includes an annular flange 22 such that a nut 24 received onto the outer end 19 of the shaft 12 may be tightened to move against the annular flange 22.

The rock bolt 10 includes also a plurality of wedge members 26. Each of the wedge members 26 is associated with one of the clamping assemblies 16. In the embodiment shown, there are provided two such clamping assemblies 16 and two associated wedge members 26. A first of the clamping assemblies 16 is located adjacent an inner end of the rock bolt 10 and a second of the clamping assemblies 16 is located between the inner and outer ends 18 and 19 of the rock bolt 10.

Each of the wedge members 26 comprises a tapered tubular member 28. The tapered tubular members 28 are generally circular in transverse cross section and taper inwardly from a first end 50 to a second end 51. The tubular members 28 each include a longitudinal bore 30 having an internal thread to receive the external thread of the shaft 12. The wedge members 26 are oriented on the shaft 12 such that the first ends 50 thereof are directed towards the inner end 18 of the rock bolt 10 and the second ends 51 are directed towards the outer end 19 of the rock bolt 10.

Each of the clamping assemblies 16 in the embodiment shown comprises a ring 32, a pair of arms 34 and a pair of corresponding clamp members 36. The ring 32 includes an aperture for receiving the shaft 12 such that the ring 32 is located about the shaft 12 within the sleeve 14. The arms 34 comprise elongate members having first ends secured to opposite sides of the ring 32 such that the arms 34 extend longitudinally adjacent opposed sides of the shaft 12. The clamping assemblies 16 are located such that the arms 34 extend from the ring 32 towards the outer end 19 of the rock bolt 10.

Figure 6B:
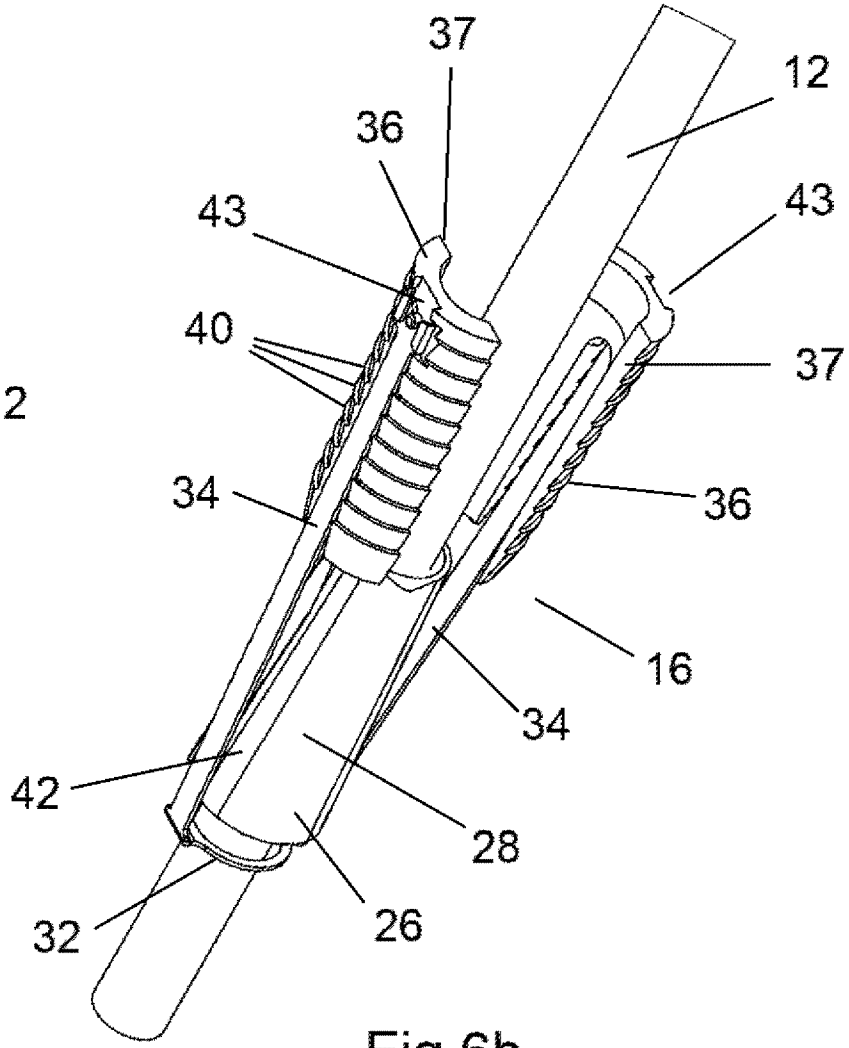
FIG. 6*b* is a view showing the clamping assembly and the wedge member mounted to the shaft.

Each of the arms 34 includes one of the clamp members 36 secured to a second end thereof, remote from the ring 32. As can be seen in FIG. 6*b*, the wedge members 26 are to be located on the shaft 12 in use between the ring 32 and the clamp member 36 of each of the clamping assemblies 16. The arms 34 of the clamping assemblies 16 are angled slightly outwardly such that the second ends of the arms 34 are located further from the shaft 12 than the first ends thereof.

The sleeve 14 is provided with a plurality of openings 38 corresponding to each of the clamp members 36. Each of the openings 38 includes a relatively wide first end portion 52 and a relatively narrow second end portion 53. The first end portion 52 of the opening 38 is located on a side adjacent the inner end 18 of the rock bolt 10. The first end portion 52 has a shape corresponding to the shape of the clamp member 36 such that the clamp member 36 may extend outwardly through the first end portion 52 of the opening 38. In the embodiment shown, the first end portion 52 of the opening 38 is rectangular. The second end portion 53 of the opening 38 has a shape corresponding to the shape of the arm 34 such that the arm 34 may extend outwardly through the second end portion 53 of the opening 38. The second end portion 53 of the opening 38 in the embodiment shown comprises an elongate channel portion. In the embodiment shown, the channel portions comprising the second end portions 53 of the openings 38 on one side of the sleeve 14 are aligned with the slot 46 such that the second end portions 53 of the openings 38 on that side of the sleeve 14 are formed by portions of the slot 46.

The arms 34 on which the clamp members 36 are mounted are flexible and resilient such that the clamp members 36 may be moved inwardly into the openings 38 such that the clamp members 36 are retained within the extents of the sleeve 14. The resilience of the arms 34 however tends to move the clamp members 36 outwardly to engage with an inner surface of the drilled hole.

In the embodiment shown, each of the clamp members 36 comprises a part cylindrical member 37. The part cylindrical members 37 are arcuate in transverse cross section such that the clamp members 36 extend around a portion of the outer surface of the shaft 12. An outer surface of each of the part cylindrical members 37 includes a plurality of ribs 40. The ribs 40 extends circumferentially around the part cylindrical member 37. The ribs 40 are triangular in shape such that when the ribs 40 engage with an inner surface of the drilled hole, the ribs 40 provide a greater resistance to sliding movement along the inner surface in a direction outwardly relative to the hole than in a direction inwardly relative to the hole.

Figure 6A:
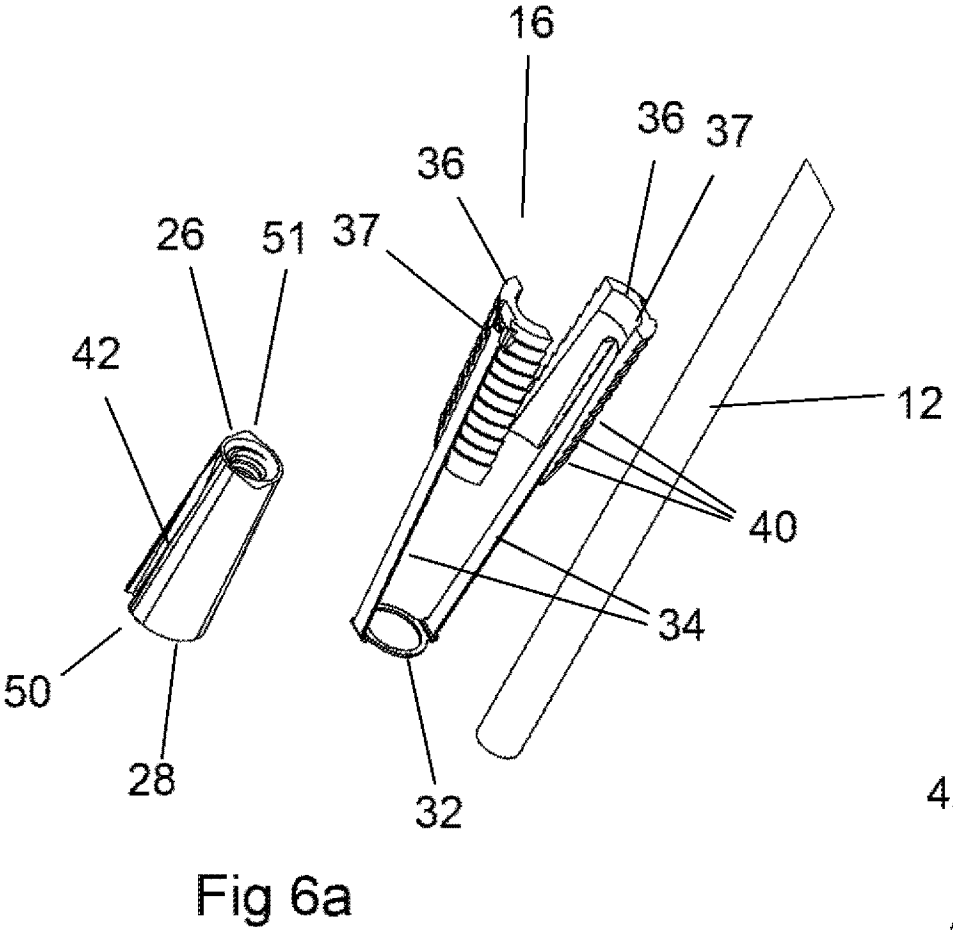
FIG. 6*a* is a view showing the clamping assembly and wedge member separated from the shaft.
Figure 7A:
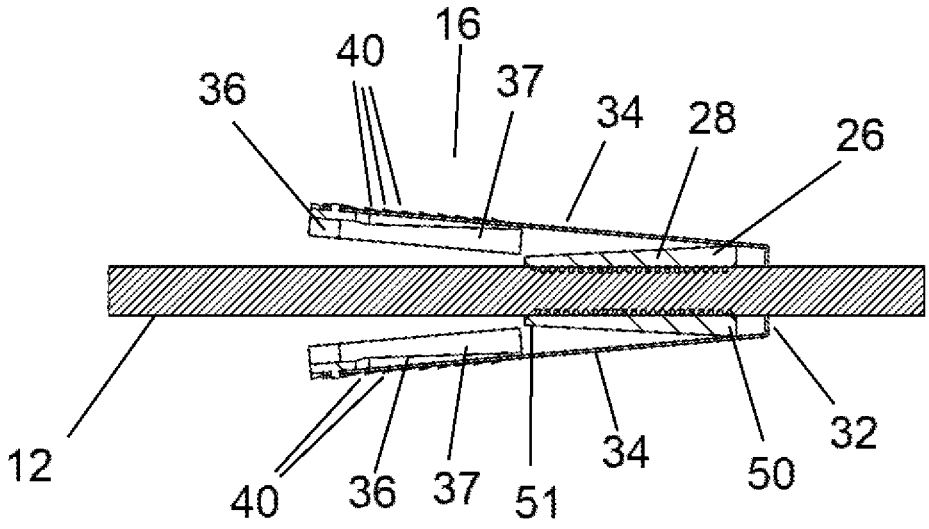
FIG. 7*a* is a side cross sectional view of the clamping assembly and the wedge member mounted to the shaft.
Figure 7B:
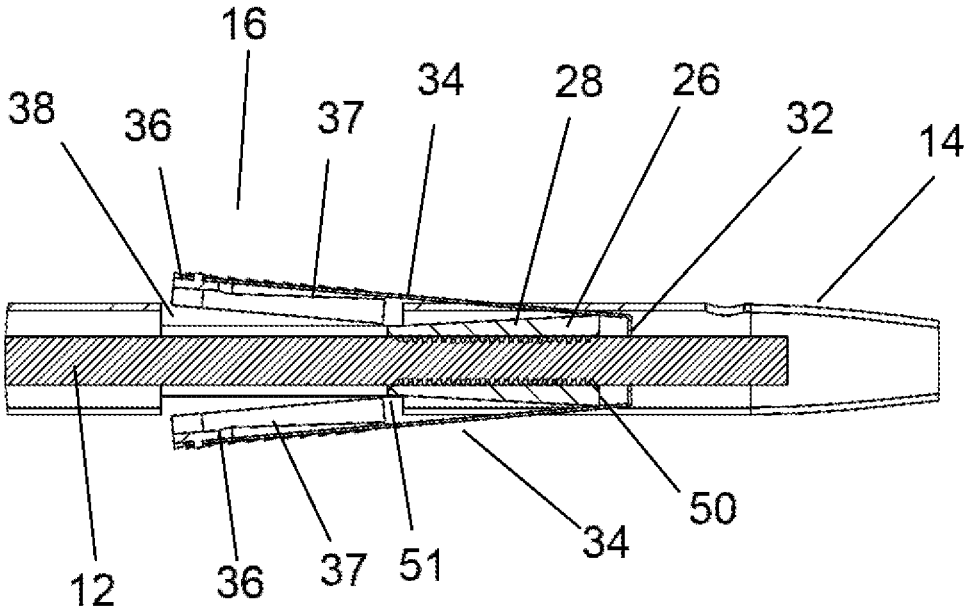
FIG. 7*b* is a side cross sectional view of the clamping assembly and the wedge member mounted to the shaft within the sleeve, with the clamp members extending outwardly through openings in the sleeve.
Figure 8C:
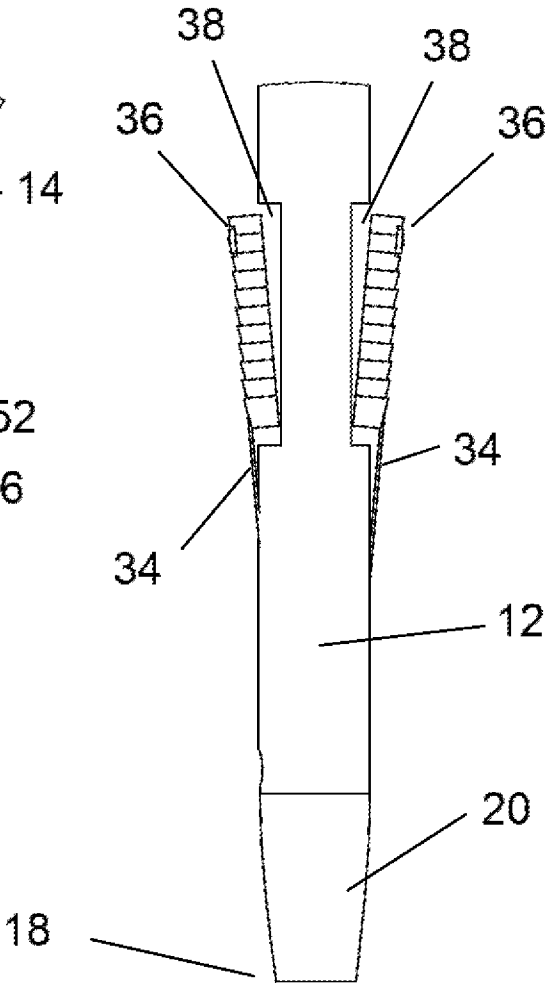
FIG. 8*c* is a side view of the first of the clamping assemblies.
Figure 8B:
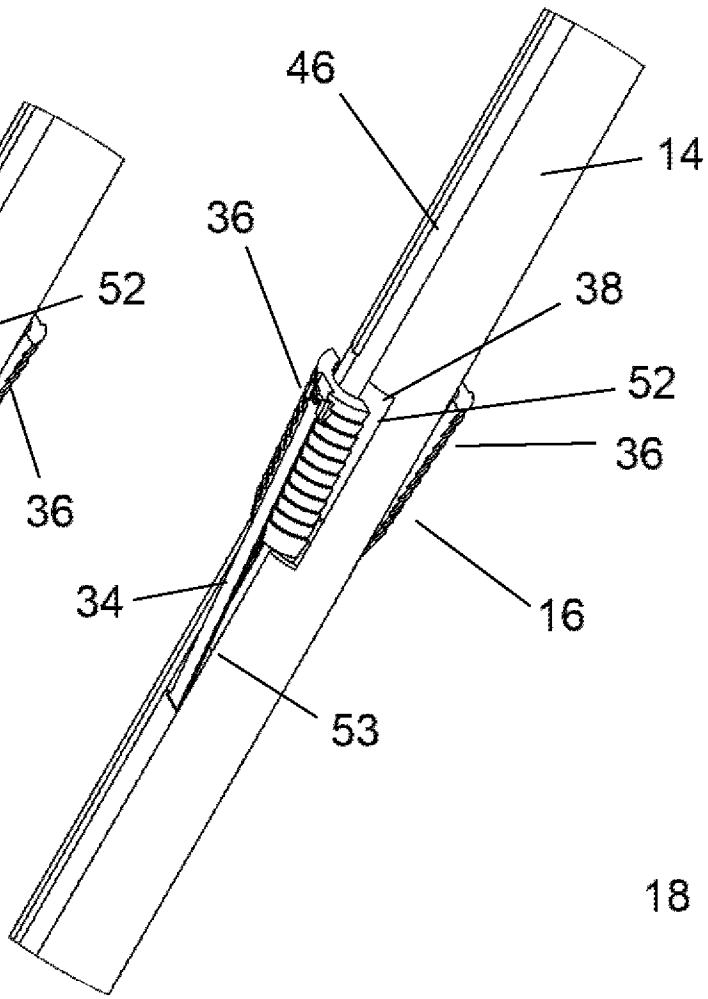
FIG. 8*b* is a perspective view of second of the clamping assembles of the rock bolt of FIG. 1.
Figure 8A:
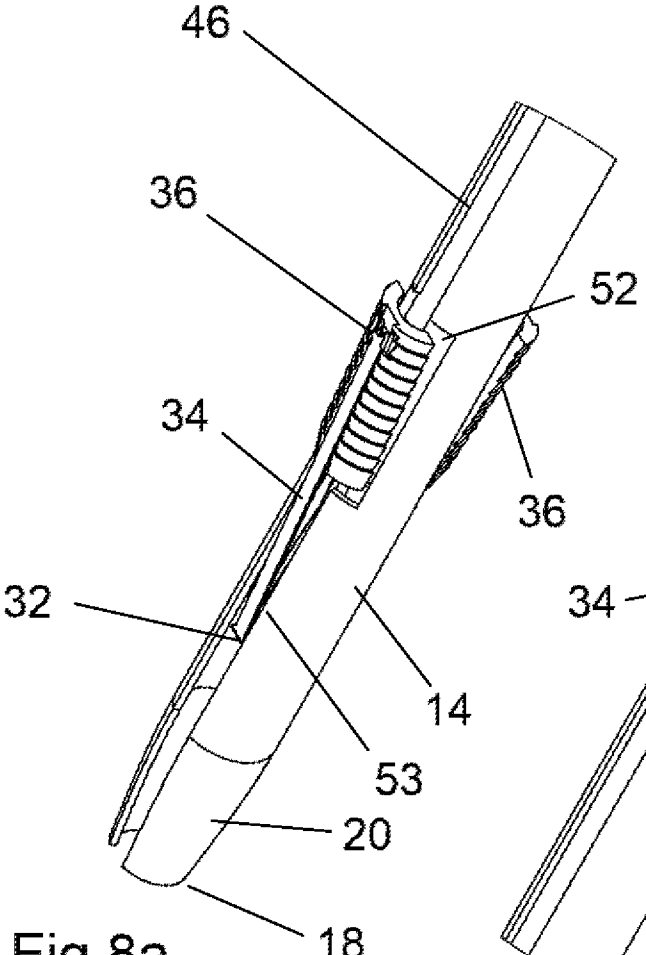
FIG. 8*a* is a perspective view a first of the clamping assemblies of the rock bolt of FIG. 1.
Figure 9:
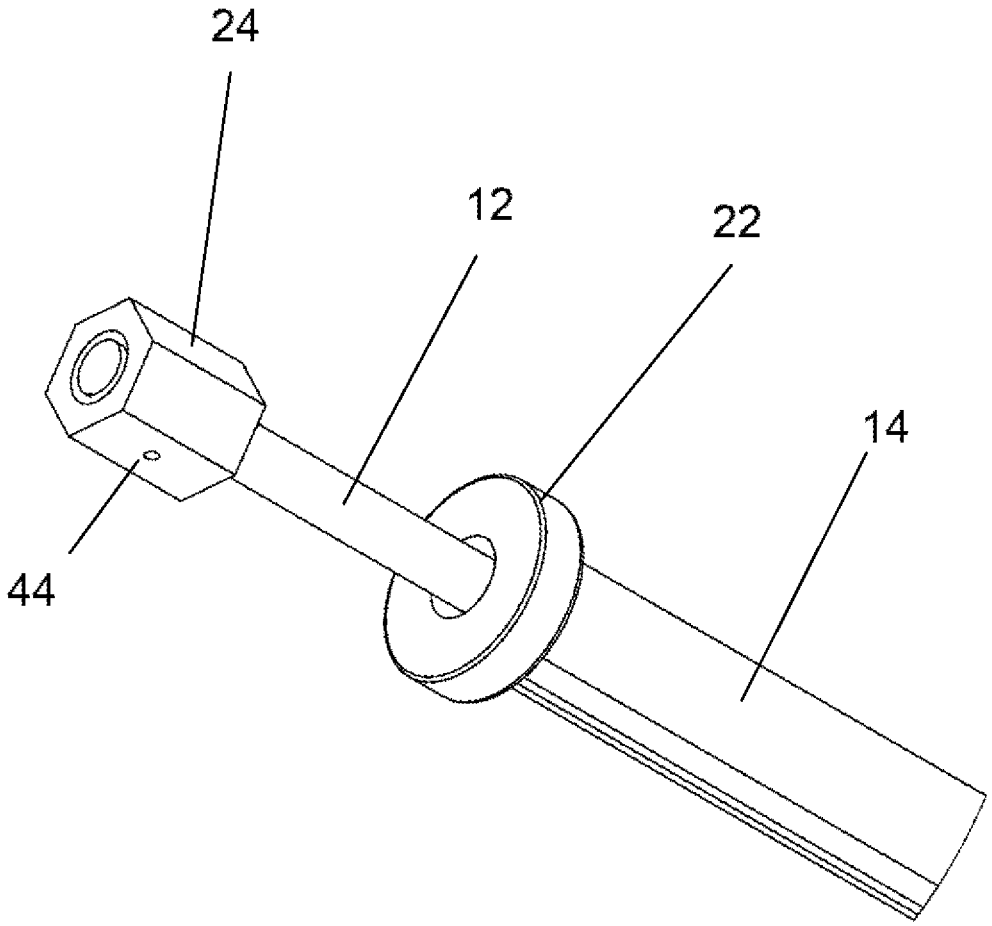
FIG. 9 is a perspective view of an outer end of the rock bolt of FIG. 1.

Each of the wedge members 26 includes a pair of longitudinal grooves 42 on opposed sides thereof. The grooves 42 are provided for receiving the arms 34 when the arms 34 are compressed towards the wedge member 26. Each of the clamp members 36 also includes a longitudinal groove 43 extending centrally from a first end to a second end thereof. The grooves 43 in the clamp members 36 are provided to receive the arms 34, as can be seen in FIGS. 6*a* and 6*b*.

In use, the rock bolt 10 is inserted into a drilled hole with the clamp members 36 located adjacent the openings 38 and the wedge members 26 located between the clamp members 36 and the rings 32 of the clamping assemblies 16. While sliding the rock bolt 10 into the hole, the clamp members 36 are pressed inwardly into the openings 38, thereby flexing the arms 34 inwardly towards the shaft 12. Once the rock bolt 10 is in the desired position, the shaft 12 is rotated by engaging a suitable tool onto the nut 24.

Rotation of the nut 24 causes the wedge members 26 to move relative to the shaft 12 in a direction towards the outer end 19 and thereby move between the pairs of clamp members 36. Outer surfaces of the wedge members 26 engage against inner arcuate surfaces of the clamp members 36, thereby moving the clamp members 36 outwardly through the openings 38 to engage inner surfaces of the drilled hole. Further tightening of the nut 24 increases the force with which the clamp members 36 engage the inner surface of the drilled hole, thereby securing the rock bolt 10 relative to the drilled hole.

A pin 44 is preferably provided extending through the nut 24 into the shaft 12 to fix the nut 24 relative to the shaft 12. The pin 44 is designed to fail on application of a predetermined force such that the clamping force between the rock bolt 10 and the drilled hole can be controlled to a desired level.

It will be readily apparent to persons skilled in the relevant arts that various modifications and improvements may be made to the foregoing embodiments, in addition to those already described, without departing from the basic inventive concepts of the present invention.

What is claimed is:

1. A rock bolt to be received in a drilled hole, the rock bolt comprising:

a threaded shaft having a length;

a sleeve into which the shaft is received, such that an annular space is defined between an inner surface of the sleeve and an outer surface of the shaft, the annular space extending a length of the sleeve into which the shaft is received, wherein the sleeve comprises a longitudinal slot extending along the length thereof to allow for compression of the sleeve when inserted into the drilled hole;

a plurality of openings along the length of the sleeve;

clamping assemblies received within said annular space having clamp members provided adjacent each opening; and wedge members located adjacent each of the clamp members;

wherein the wedge members include a threaded bore for receiving the shaft such that rotation of the shaft moves the wedge members into engagement with the clamp members to move the clamp members outwardly through the openings to engage with an inner surface of the hole.

2. The rock bolt in accordance with claim 1, wherein each of the clamping assemblies includes a pair of clamp members located on opposed sides of the shaft and a pair of opposed openings are provided for each clamping assembly.

3. The rock bolt in accordance with claim 2, wherein each clamping assembly comprises a ring having an aperture for receiving the shaft and a pair of arms having first ends secured to the ring and second ends secured to the clamp members such that the wedge members are received on the shaft between the ring and the clamp members.

4. The rock bolt in accordance with claim 3, wherein each of the openings includes a relatively wide first end portion through which one of the clamp members may extend and a relatively narrow second end portion through which a portion of one of the arms may extend.

5. The rock bolt in accordance with claim 4, wherein the first end portion of each of the openings is located on a side adjacent the inner end of the rock bolt.

6. The rock bolt in accordance with claim 5, wherein the first end portion has a shape corresponding to a shape of the clamp member such that the clamp member and the second end portion of each of the openings has a shape corresponding to a shape of one of the arms.

7. The rock bolt in accordance with claim 6, wherein the first end portion of each of the openings is rectangular and the second end portion of each of the openings comprises an elongate channel portion.

8. The rock bolt in accordance with claim 4, wherein the second end portions of the openings on one side of the sleeve are aligned with the slot such that the second end portions of the openings on said one side of the sleeve are formed by portions of the slot.

9. The rock bolt in accordance with claim 3, wherein the arms of the clamping assemblies are angled outwardly such that the second ends of the arms are located further from the shaft than the first ends thereof and wherein the arms are flexible and resilient.

10. The rock bolt in accordance with claim 3, wherein each of the clamp members comprises a part cylindrical member such that the clamp members extend around a portion of an outer surface of the shaft.

11. The rock bolt in accordance with claim 10, wherein an outer surface of each of the part cylindrical members includes a plurality of circumferential ribs.

12. The rock bolt in accordance with claim 11, wherein the ribs are triangular in shape such that when the ribs engage with an inner surface of the drilled hole, the ribs provide a greater resistance to sliding movement along the inner surface in a direction outwardly relative to the hole.

13. The rock bolt in accordance with claim 10, wherein each of the clamp members includes longitudinal grooves extending centrally from the first ends to second ends thereof to receive the arms.

14. The rock bolt in accordance with claim 1, wherein each of the wedge members comprises a tapered tubular member being circular in transverse cross section and tapering inwardly from a first end to a second end.

15. The rock bolt in accordance with claim 14, wherein each of the wedge members includes a pair of longitudinal grooves on opposed sides thereof for receiving a pair of arms.

* * * * *